US010076819B2

(12) United States Patent
Ulrich

(10) Patent No.: US 10,076,819 B2
(45) Date of Patent: Sep. 18, 2018

(54) SANDPAPER SHEET FOR USE WITH TOOLS CONFIGURED FOR DUST EXTRACTION

(71) Applicant: Barry Ulrich, Victoria (CA)

(72) Inventor: Barry Ulrich, Victoria (CA)

( * ) Notice: Subject to any disclaimer, the term of this patent is extended or adjusted under 35 U.S.C. 154(b) by 290 days.

(21) Appl. No.: 14/709,357

(22) Filed: May 11, 2015

(65) Prior Publication Data

US 2015/0328747 A1 Nov. 19, 2015

Related U.S. Application Data

(60) Provisional application No. 61/993,940, filed on May 15, 2014.

(51) Int. Cl.
*B24B 55/10* (2006.01)
*B24D 11/00* (2006.01)
*B24D 18/00* (2006.01)

(52) U.S. Cl.
CPC ..... *B24B 55/10* (2013.01); *B24D 11/00* (2013.01); *B24D 11/008* (2013.01); *B24D 18/0045* (2013.01); *B24B 55/105* (2013.01)

(58) Field of Classification Search
CPC ..... B24B 7/182; B24B 7/184; B24B 55/10; B24B 55/105; B24B 37/22; B24B 37/24; B24D 18/0045
See application file for complete search history.

(56) References Cited

U.S. PATENT DOCUMENTS 4,549,371 A 10/1985 Hakoda
4,779,385 A * 10/1988 Reiter ..... B24B 55/10 451/354
4,839,995 A * 6/1989 Hutchins ..... B24B 23/04 451/357
5,022,190 A * 6/1991 Hutchins ..... B24B 23/043 451/357
5,445,558 A * 8/1995 Hutchins ..... B24B 55/10 451/344
5,582,541 A * 12/1996 Hutchins ..... B24B 23/03 451/344
5,885,146 A 3/1999 Cockburn
6,132,300 A 10/2000 Martin
(Continued)

OTHER PUBLICATIONS http://www.arichard.com/en/catalog/sand-paper/pre-cut-perforated-sandpaper,-grit-100/.

*Primary Examiner* — Timothy V Eley
(74) *Attorney, Agent, or Firm* — Baumgartner Patent Law

(57) ABSTRACT

A sander for use with a vacuum extraction system is provided. The sander comprises a body, a releasable retention mechanism on an upper surface adjacent each end of the body, a platen, the platen adjacent to and attached to a lower surface of the body and having a pattern of grooves, an at least one vacuum port extending through the body and platen and positioned such that the grooves in the platen are substantially directed to the at least one vacuum port, wherein the improvement comprises a perforated sandpaper sheet, the perforated sandpaper sheet comprising: an upper sandpaper layer; a lower plastic polymer foam layer; and a plurality of apertures in a plurality of series; the plurality of series of apertures in a pattern configured to align with the pattern of grooves in the platen of the sander, the plurality of apertures occupying about 5 percent of an upper surface area of the sandpaper sheet.

5 Claims, 3 Drawing Sheets

(56) References Cited

U.S. PATENT DOCUMENTS

| | | | | |
|---|---|---|---|---|
| 6,142,155 | A * | 11/2000 | Rudolph | A45D 29/04 132/76.4 |
| 6,179,696 | B1 | 1/2001 | Duffy | |
| 7,249,996 | B1 * | 7/2007 | Volyar | B24B 7/184 451/354 |
| RE40,345 | E | 5/2008 | Duffy | |
| 2002/0031992 | A1 * | 3/2002 | Clowers | B24B 23/03 451/357 |
| 2004/0029505 | A1 * | 2/2004 | Whitty | B24B 55/10 451/354 |
| 2007/0212985 | A1 * | 9/2007 | Boler, Jr. | B24D 15/04 451/28 |
| 2007/0232210 | A1 | 10/2007 | Chen | |
| 2007/0232211 | A1 | 10/2007 | Chen | |
| 2010/0009609 | A1 * | 1/2010 | Dow | B24B 7/184 451/522 |
| 2015/0056898 | A1 * | 2/2015 | Christen | B24B 55/10 451/488 |
| 2016/0031059 | A1 * | 2/2016 | McNall | A63B 47/00 451/159 |
| 2016/0279759 | A1 * | 9/2016 | Annis | B24B 55/10 |

* cited by examiner

SANDPAPER SHEET FOR USE WITH TOOLS CONFIGURED FOR DUST EXTRACTION

CROSS-REFERENCE TO RELATED APPLICATIONS

This application claims the benefit of U.S. Patent Application Ser. No. 61/993,940 filed on 15 May 2014. The entire content of the above-identified prior application is hereby incorporated by reference.

FIELD OF THE INVENTION

The present technology is a sandpaper sheet that is provided with a plurality of apertures located to align with extraction grooves in the tool. More specifically, the technology is a sandpaper sheet with visual and physical queues to allow for rapid and accurate placement of the sheet on a drywall sander.

BACKGROUND

There are numerous situations in which construction dust must be contained as best as possible. For example, renovations in offices with computer equipment, renovations in research labs with electronics, and in hospitals where dust could adversely affect the health of the patients. Dust extraction systems are used in these situations, but often to collect dust that has first escaped and is then caught and extracted.

For example, U.S. Pat. No. 4,549,371 discloses an apparatus for collecting dust for a sander. The sander has a generally planar sanding platen affixed to the main body of the sander by several flexible support columns. The sanding platen is driven by an eccentric mounted on a shaft from the main body of the sander. That same shaft drives a fan in a chamber in the main body that is in flow communication with passages through the main body, through the flexible support columns, through a portion of the sanding platen to holes in the platen that are coincident with holes in the sandpaper. Dust from the workpiece being sanded passes through the holes into the platen, through the support columns to the fan chamber without exposing bearings, supporting the shaft and the eccentric, to the dust. As shown in the drawings, there are a few holes adjacent the periphery of the sandpaper that must be carefully aligned with the counterpart holes in the platen and adjacent layer in order for the dust to be extracted. Grooves in layer and sandpaper sheet, when mounted on the underside of layer, define a passage through which dust can be sucked from the surface of the workpiece, from the peripheral edge region of sandpaper sheet and from the vicinity adjacent the sander. Hence, a significant amount of dust escapes from the device and is then sucked up. As the dust under the central section of the device is not extracted directly, the amount of dust escaping is considerable. Further, the sandpaper must be carefully placed in order to align the holes correctly.

U.S. Pat. Nos. RE40,345, 6,179,696, 6,132,300 and 5,885,146 disclose an oscillating hand tool that has an extractor. A perforated sandpaper sheet may be attached to the outer face of the platen, for example by the use of hook-and-loop fabric such as that sold as VELCRO® glued to face. Holes passing through the platen facilitate the removal of dust etc., from the sanding face through the platen to exhaust outlet via the duct. An extractor hose may be attached to the exhaust outlet. There is no disclosure nor are there drawings providing any further information on the perforations.

Richard® supplies perforated sandpaper for use in sanding drywall. The sandpaper has a thin layer of a material that will attach to the hooks of VELCRO®. The holes are small (1 mm in diameter with about 14 in a row across the sheet of sandpaper (8.5 cm wide and 29.5 cm long) spaced apart by about 4 mm. In use, the perforated sandpaper traps drywall and paint dust in the holes and on the sandpaper, hence it does not allow for ready extraction of the dust. Further, no attempts were made to align the holes with extraction apertures in the sander.

It is preferable that the sandpaper holes are aligned with the holes in the device. This can be difficult to accomplish. US Publication No. 20070232211 addresses this problem by providing a perforated sandpaper alignment device, which is used to accommodate and position perforated sandpapers having multiple through-holes thereon and comprises a seat. The seat has a base; the base has a column, which the perforated sandpapers are put around, and at least one fixing pole, which is arranged corresponding to one through-hole and used to position the perforated sandpapers. Thereby, multiple perforate sandpapers may be put on the seat and positioned by the seat.

Similarly, US Publication No. 20070232210 discloses a fast-perforated sandpaper-replacing device, which is used to attach a perforated sandpaper to a grinder. The device comprises a casing. The casing has a through-hole, an aligner installed on its surface, and a movable member installed thereinside. An elastic element is arranged between the movable member and the bottom of the casing. A perforated sandpaper alignment device, which penetrates the through-hole, is coupled to the movable member. A grinder is aligned to the fast-perforated sandpaper-replacing device with the aligner. When pressed by a force, the grinder further presses down the movable member and the elastic element and moves toward the perforated sandpapers accommodated by the alignment device. Thus, the grinding disc of the grinder can precisely stick onto the topmost perforated sandpaper.

What is needed is a sandpaper sheet that has perforations that are large enough to allow drywall dust, paint dust and the like to travel through the individual apertures freely and that are aligned with the grooves in the platen of a vacuum sander. Preferably, there are numerous apertures, with both the size and number of apertures being selected to allow for good removal of dust while not unduly compromising the sanding surface. Preferably, there will be visual and physical queues to ensure easy and rapid alignment of the apertures with the grooves. More preferably, the apertures will be of sufficient depth to provide a wall contour that further promotes rapid and efficient extraction.

SUMMARY

The present technology is a sandpaper sheet and a combination of a sander for use with a vacuum extractor and the sandpaper sheet. The sandpaper sheet has series of round apertures that are for alignment with grooves in the platen of the sander. The sandpaper sheet also is sized such that it clamps into the end clamps of the sander with a minimum of excess, thus providing a physical queue of correct placement of the sheet. The sandpaper sheet is also provided with at least one mark or trace on a sidewall that is aligned with the centre of an aperture in the outer series of apertures for aligning with the centre of a groove, to provide a visual queue for correctly locating the sheet. The walls of the apertures are funnel-shaped or tapered to allow for minor misalignments and to reduce the chance of the apertures plugging with dust.

In one embodiment, a sandpaper sheet for use with a vacuum extraction sander is provided, the vacuum extraction sander having a platen with a pattern of grooves substantially covering the platen surface, the sandpaper sheet comprising: an upper sandpaper layer; a lower plastic polymer foam layer; and a plurality of apertures in a plurality of series of apertures; the plurality of series of apertures in a pattern configured to align with the pattern of grooves in the platen of the sander, the apertures having a diameter of about 4 mm, and being distributed about 10 mm to about 15 mm apart over the sandpaper sheet, centre to centre.

The sandpaper sheet may further comprise a pair of central apertures, the central apertures having a diameter of about 8 mm.

In the sandpaper sheet the apertures may occupy about 5 percent of an upper surface area of the sandpaper sheet.

In the sandpaper sheet, the apertures may be substantially circular.

In the sandpaper sheet, the apertures may have an entrance port, an exit port and a bore therebetween, the bore tapering outwardly between the entrance port and the exit port, the exit port having a larger diameter than the entrance port.

In another embodiment, a sander for use with a vacuum extraction system is provided. The sander comprises a body, a releasable retention mechanism on an upper surface adjacent each end of the body, a platen, the platen adjacent to and attached to a lower surface of the body and having a pattern of grooves, an at least one vacuum port extending through the body and platen and positioned such that the grooves in the platen are substantially directed to the at least one vacuum port, wherein the improvement comprises a perforated sandpaper sheet, the perforated sandpaper sheet comprising: an upper sandpaper layer; a lower plastic polymer foam layer; and a plurality of apertures in a plurality of series; the plurality of series of apertures in a pattern configured to align with the pattern of grooves in the platen of the sander, the plurality of apertures occupying about 5 percent of an upper surface area of the sandpaper sheet.

In the sander, an aperture may be about 4 mm in diameter, and the apertures may be distributed about 10 mm to about 15 mm apart over the sandpaper sheet, centre to centre.

The sander may further comprise a pair of central apertures, the central apertures having a diameter of about 8 mm.

In the sander, the apertures may have an entrance port, an exit port and a bore therebetween, the bore tapering outwardly between the entrance port and the exit port, the exit port having a larger diameter than the entrance port.

In the sander, the apertures may be substantially circular.

In another embodiment, a method of producing a sandpaper sheet for use with a vacuum extraction sander is provided, the method comprising affixing a length of a sandpaper roll in a jig, selecting a programme for a specific pattern of apertures on a computer numerical control machine to direct a laser emitter to etch a plurality of series of apertures into the length of the sandpaper roll and to direct the laser emitter to focus a beam on an upper sandpaper layer of the length of sandpaper roll and to diverge the beam in a lower plastic polymer foam layer to produce an aperture with a smaller entrance port, a larger exit port and a tapered bore therebetween, producing the apertures, and cutting the length of sandpaper roll to a selected length.

The method may further comprise marking a trace on the upper surface and a side of the length of sandpaper roll, the trace aligned with a selected series of apertures. The method may further comprise the laser emitter being directed to etch two central apertures through the length of the sandpaper roll and to direct the laser emitter to focus a beam on an upper sandpaper layer of the length of sandpaper roll and to diverge the beam in a lower plastic polymer foam layer to produce the central apertures with a smaller entrance port, a larger exit port and a tapered bore therebetween.

In the method, the apertures in the plurality of the series of series of apertures may be about 4 mm in diameter, and the apertures may be distributed about 10 mm to about 15 mm apart over the sandpaper sheet, centre to centre.

In the method, the apertures in the series and the central apertures may occupy about 5% of a surface area of the upper sandpaper layer.

In another embodiment, a method of producing a sandpaper sheet for use with a vacuum extraction sander is provided, the method comprising affixing a length of a sandpaper roll to a jig, selecting a specific pattern of apertures, directing a tapered punch to punch a plurality of series of apertures into the length of the sandpaper roll to produce apertures with a smaller entrance port, a larger exit port and a tapered bore therebetween.

The method may further comprise marking a trace on the upper surface and a side of the length of sandpaper roll, the trace aligned with a selected series of apertures.

The method may further comprise the tapered punch being directed to punch two central apertures through the length of the sandpaper roll to produce the central apertures with a smaller entrance port, a larger exit port and a tapered bore therebetween.

In the method, the apertures in the plurality of the series of series of apertures may be about 4 mm in diameter, and the apertures may be distributed about 10 mm to about 15 mm apart over the sandpaper sheet, centre to centre.

In the method, the apertures in the series and the central apertures may occupy about 5% of a surface area of the upper sandpaper layer.

In another embodiment, a method of producing a sandpaper sheet for use with a vacuum extraction sander is provided, the method comprising affixing a length of a sandpaper roll in a jig, selecting a programme for a specific pattern of apertures on a computer numerical control machine to direct a laser emitter to etch a plurality of series of apertures into the length of the sandpaper roll and to direct the laser emitter to focus a beam on an upper sandpaper layer of the length of sandpaper roll and to diverge the beam in a lower plastic polymer foam layer to produce an aperture with a smaller entrance port, a larger exit port and a tapered bore therebetween, producing the apertures, and cutting the length of sandpaper roll to a selected length.

The method may further comprise marking a trace on the upper surface and a side of the length of sandpaper roll, the trace aligned with a selected series of apertures.

The method may further comprise the laser emitter being directed to etch two central apertures through the length of the sandpaper roll and to direct the laser emitter to focus a beam on an upper sandpaper layer of the length of sandpaper roll and to diverge the beam in a lower plastic polymer foam layer to produce the central apertures with a smaller entrance port, a larger exit port and a tapered bore therebetween.

In the method, the apertures in the plurality of the series of series of apertures may be about 4 mm in diameter, and the apertures may be distributed about 10 mm to about 15 mm apart over the sandpaper sheet, centre to centre.

In the method, the apertures in the series and the central apertures may occupy about 5% of a surface area of the upper sandpaper layer.

In yet another embodiment, a method of producing a sandpaper sheet for use with a vacuum extraction sander, the method comprising: i) affixing a length of a sandpaper roll in a jig, and either: selecting a programme for a specific pattern of apertures on a computer numerical control machine to direct a laser emitter to etch a plurality of series of apertures into the length of the sandpaper roll and to direct the laser emitter to focus a beam on an upper sandpaper layer of the length of sandpaper roll and to diverge the beam in a lower plastic polymer foam layer to produce an aperture with a smaller entrance port, a larger exit port and a tapered bore therebetween; or directing a tapered punch to punch a plurality of series of apertures into the length of the sandpaper roll to produce an aperture with a smaller entrance port, a larger exit port and a tapered bore therebetween; ii) producing the apertures; iii) and cutting the length of sandpaper roll to a selected length.

The method may further comprise marking a trace on the upper surface and a side of the length of sandpaper roll, the trace aligned with a selected series of apertures.

The method may further comprise the laser emitter being directed to etch two central apertures through the length of the sandpaper roll and to direct the laser emitter to focus a beam on an upper sandpaper layer of the length of sandpaper roll and to diverge the beam in a lower plastic polymer foam layer to produce the central apertures with a smaller entrance port, a larger exit port and a tapered bore therebetween.

In the method the apertures in the plurality of the series of series of apertures may be about 4 mm in diameter, and the apertures may be distributed about 10 mm to about 15 mm apart over the sandpaper sheet, centre to centre.

In the method, the apertures in the series and the central apertures may occupy about 5% of a surface area of the upper sandpaper layer.

The method may further comprise the tapered punch being directed to punch two central apertures through the length of the sandpaper roll to produce the central apertures with a smaller entrance port, a larger exit port and a tapered bore therebetween.

In the method the apertures in the plurality of the series of series of apertures may be about 4 mm in diameter, and the apertures may be distributed about 10 mm to about 15 mm apart over the sandpaper sheet, centre to centre.

In the method, the apertures in the series and the central apertures may occupy about 5% of a surface area of the upper sandpaper layer.

DETAILED DESCRIPTION

Except as otherwise expressly provided, the following rules of interpretation apply to this specification (written description, claims and drawings): (a) all words used herein shall be construed to be of such gender or number (singular or plural) as the circumstances require; (b) the singular terms "a", "an", and "the", as used in the specification and the appended claims include plural references unless the context clearly dictates otherwise; (c) the antecedent term "about" applied to a recited range or value denotes an approximation within the deviation in the range or value known or expected in the art from the measurements method; (d) the words "herein", "hereby", "hereof", "hereto", "hereinbefore", and "hereinafter", and words of similar import, refer to this specification in its entirety and not to any particular paragraph, claim or other subdivision, unless otherwise specified; (e) descriptive headings are for convenience only and shall not control or affect the meaning or construction of any part of the specification; and (f) "or" and "any" are not exclusive and "include" and "including" are not limiting. Further, The terms "comprising," "having," "including," and "containing" are to be construed as open ended terms (i.e., meaning "including, but not limited to,") unless otherwise noted.

To the extent necessary to provide descriptive support, the subject matter and/or text of the appended claims is incorporated herein by reference in their entirety. Recitation of ranges of values herein are merely intended to serve as a shorthand method of referring individually to each separate value falling within the range, unless otherwise indicated herein, and each separate value is incorporated into the specification as if it were individually recited herein. Where a specific range of values is provided, it is understood that each intervening value, to the tenth of the unit of the lower limit unless the context clearly dictates otherwise, between the upper and lower limit of that range and any other stated or intervening value in that stated range, is included therein. All smaller sub ranges are also included. The upper and lower limits of these smaller ranges are also included therein, subject to any specifically excluded limit in the stated range.

Unless defined otherwise, all technical and scientific terms used herein have the same meaning as commonly understood by one of ordinary skill in the relevant art. Although any methods and materials similar or equivalent to those described herein can also be used, the acceptable methods and materials are now described.

Figure 1:
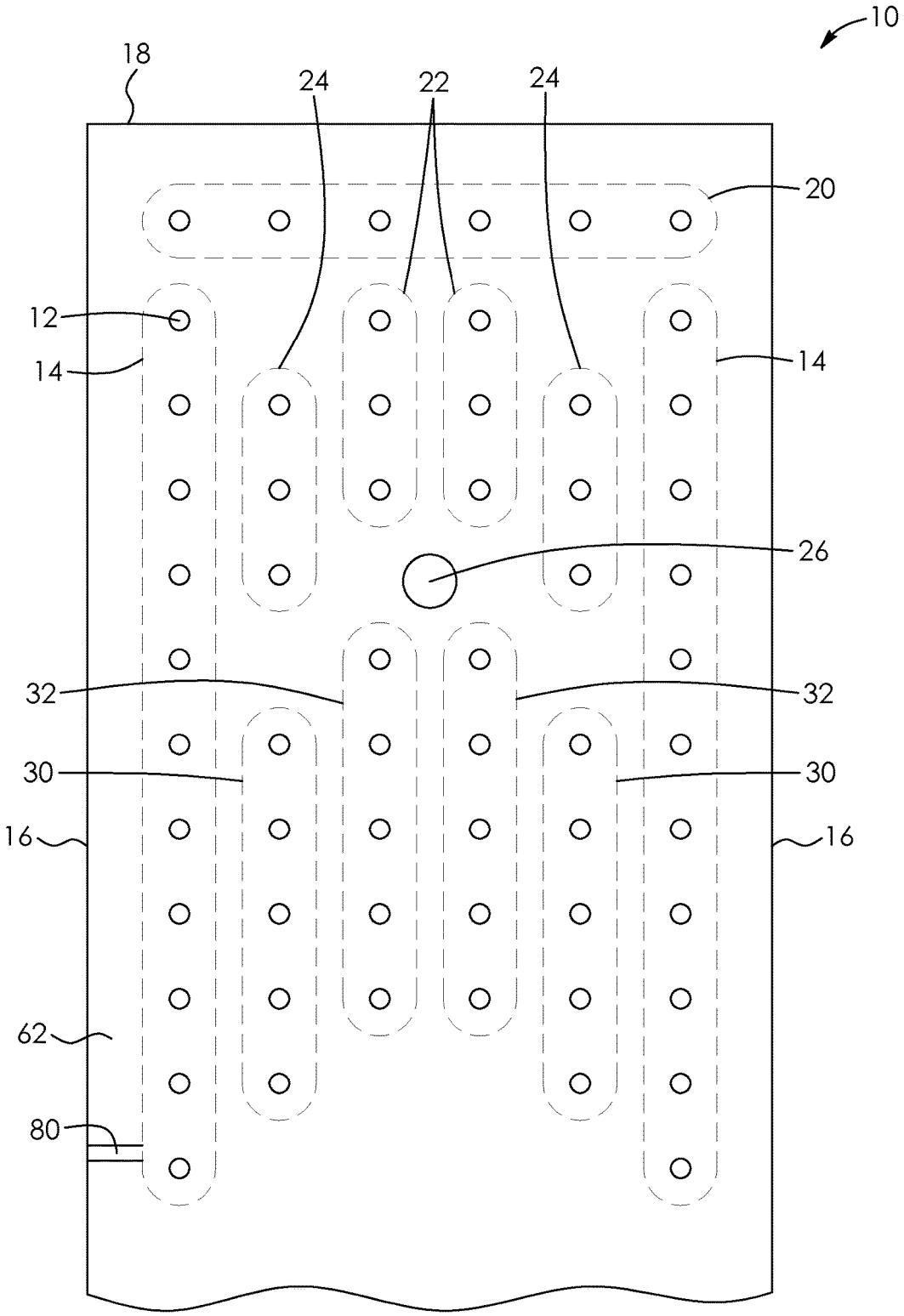
FIG. 1 is a plan view of the sandpaper sheet of the present technology. The dashed lines are not part of the invention, and are used to illustrate the various series of apertures.

A sandpaper sheet, generally referred to as 10 is shown in FIG. 1. The sheet comprises a plurality of apertures 12. An outer long side series, generally referred to as 14, is located about 6 to about 9 mm on centre from a long edge 16, or about 7 mm on centre, or all distances therebetween. The apertures 12 in the outer long side series 14 are spaced about 12 mm or about 15 mm and all distances therebetween apart, centre to centre and commence about 36 mm or about 38 mm and all distances therebetween from the short edge 18. An outer short side series, generally referred to as 20, is located about 20 to about 22 mm and all distances therebetween on centre from the short edge 18. The apertures 12 in the outer short side series 20 are spaced about 10 mm or about 12 mm or all distances therebetween apart centre to centre and commence about 10 to about 12 mm from the long edge 16. A central series, generally referred to as 22, commences about 36 mm or about 38 cm from the short edge 18 on centre and each row is about 36 mm or about 38 mm from the closest long edge 16 on centre. There are three apertures 12 in two rows in the series and the apertures 12 are spaced about 12 or about 15 mm apart, centre to centre. An intermediate series, generally referred to as 24 is located about 22 mm to about 24 mm from the closest long edge 16.

There are three apertures 12 in two rows in the series. The rows commence about 40 to about 44 mm from the short edge 18. A larger central aperture 26 is located about 72 to about 75 mm from the short edge 18 and about 40 mm from the long edge 16, on centre. There is one central aperture 26 per end. The central apertures have a diameter of about 8 mm or about 10 mm or about 9 mm. The adjacent series, generally referred to as 30, commence about 40 mm to about 44 mm on centre from the short edge 18 and about 22 mm to about 25 mm from the closest long edge 16. The apertures 12 are spaced apart by about 12 mm to about 15 mm centre to centre. The core series, generally referred to as 32, extends between the central apertures 26. The apertures commence about 85 mm to about 90 mm from the short edge 18 on centre, and are about 32 mm to about 35 mm from the closest long edge 16. The apertures 12 are about 12 mm to about 15 mm apart, centre to centre. The apertures in all the series have a diameter of about 3 mm to about 5 mm or 4 mm. In all cases, the cited distances include any distances between the cited distances.

Figure 2:
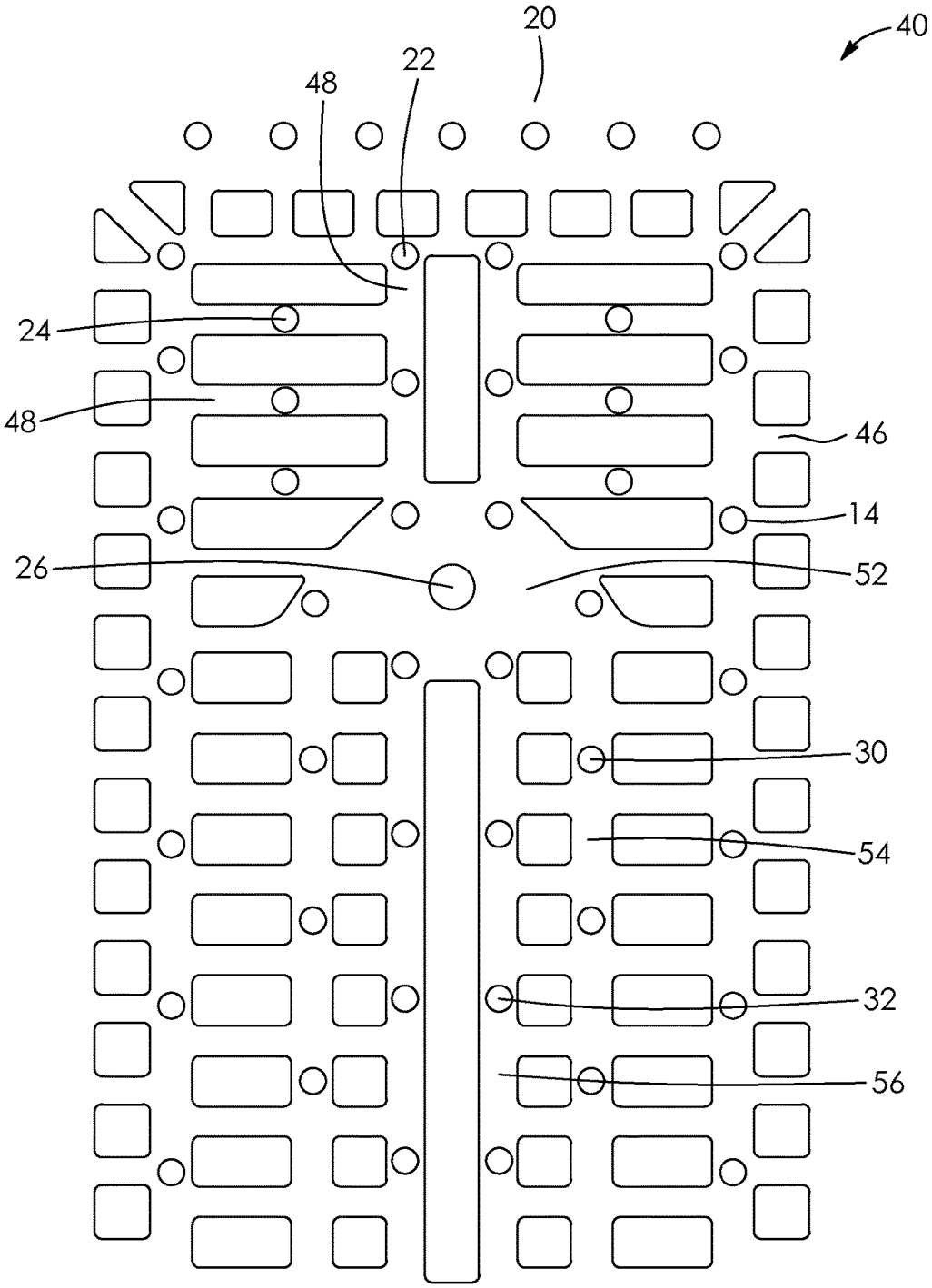
FIG. 2 is a schematic of an exemplary example of the relationship between the sander platen and the sandpaper sheet.

The significance of the distances between apertures 12 and the arrangement of the apertures 12 can be seen in FIG. 2, where the sandpaper sheet 10 is superimposed on the platen, generally referred to as 40. The various rectangular, trapezoidal and triangular shapes are raised portions on the platen and define the various grooves and bores. In this figure, one representative aperture of each series is labeled to indicate the location of the series. The outer short side series 20 are outside of the platen 40 so as to collect any dust that escapes from the trailing edge of the platen 40. The long side series 14 is aligned with the outer long side grooves 46 of the platen. The central series 22 is aligned in the central grooves 48 of the platen. The intermediate series 24 is located, one per groove, in an intermediate series of grooves 50 of the platen. The central apertures 26 are aligned with the vacuum bores 52 of the platen. The adjacent series 30 are aligned with an adjacent series of grooves 54 of the platen. The core series 32 are aligned with the core grooves 56 of the platen.

Figure 3:
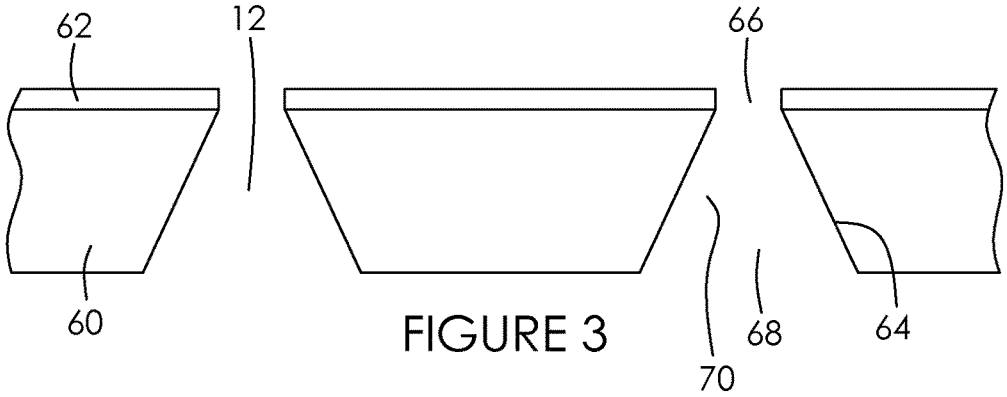
FIG. 3 is a cross sectional view through an aperture of the sandpaper sheet of FIG. 1.

FIG. 3 shows a cross section through the sheet of sandpaper 10. An inner layer 60 is a plastic polymer foam that is adhered to an outer layer 62 that is sandpaper. The apertures 12 comprise a wall 64, an entrance port 66, an exit port 68 and a bore 70 therebetween. The ports 66, 68 are round or of similar non-angular shapes, for example, elliptical. The wall 74 tapers from the entrance port 66 to the exit port 68 to provide a tapered bore 70 with a larger diameter exit port 68 and a smaller diameter entrance port 66. Without being bound to theory, this reduces the chance of dust lodging in the aperture 12 and provides a wider margin for error in aligning the apertures with the grooves.

Figure 4:
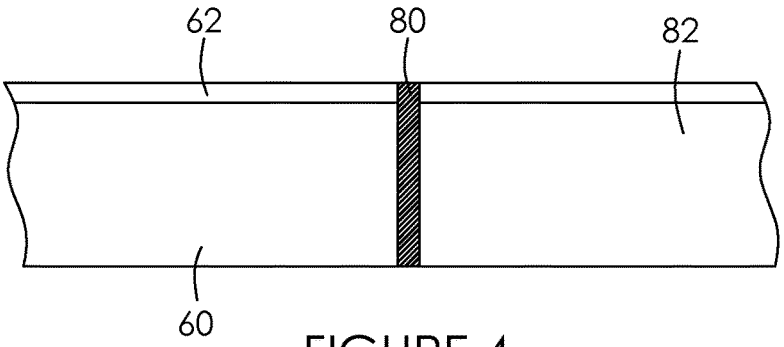
FIG. 4 is a perspective view of the sandpaper sheet of FIG. 1 on a vacuum extraction sander.

As shown in FIG. 4, a trace or mark 80 on the side 82 of the sandpaper sheet 10 provides a means for aligning the sheet 10 appropriately. The trace or mark 80, when aligned with an outer long side groove 40, indicates that the apertures are substantially aligned with the grooves. As shown in FIG. 1, the trace or mark extends onto the outer layer 62 to help guide a user.

As shown in FIG. 4, the sandpaper sheet 10 is of sufficient length to be retained by the clamps 84 of the sander 86 with little extra, for example, preferably about 55 mm longer than the platen 40 of the sander 86. This provides a physical queue to assist in aligning the sandpaper sheet 10.

Figure 5:
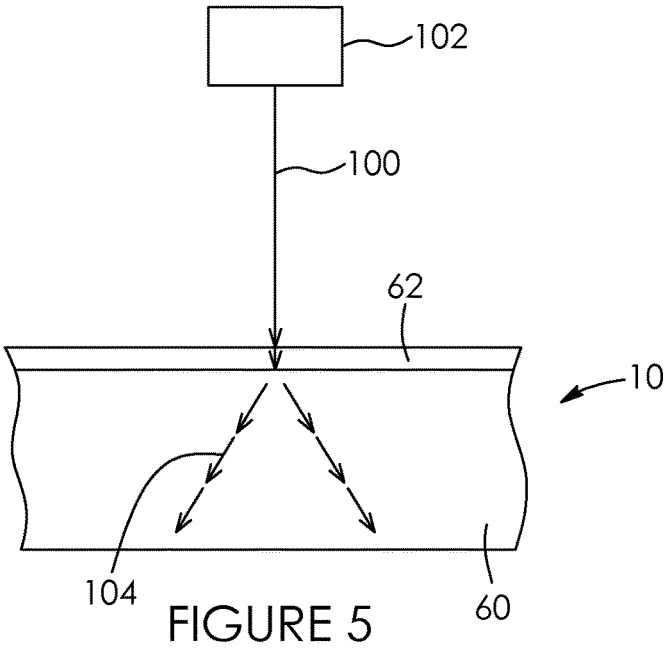
FIG. 5 shows the laser beam forming the aperture of FIG. 3.

The method of producing the sandpaper sheet is shown in FIG. 5. A roll of sandpaper having an upper layer of sandpaper and a lower layer of plastic polymer foam is selected. The foam layer is about 5 mm thick and the upper layer of sandpaper is about 1 mm thick. A beam 100 emitted from a laser emitter 102 is focused on the upper layer 62 and is defocused to produce a diverging beam 104 in the foam layer 660. Without being bound to theory, the lower density of the foam layer in relation to the higher density of the upper layer promotes the divergence, hence the combination of materials chosen and beam focusing produces the desired tapered bore of the aperture. Using a computer numerical control (CNC) machine, the desired pattern of apertures is obtained using the laser emitter to cut the tapered bores. The sheets are then cut to length.

In an alternative method, a tapered punch is used to produce the tapered aperture. The tapered punches are arranged in the desired pattern, much like a dibbler.

Example 1: Development of the Sandpaper Sheet

The pattern of apertures, size of apertures, ratio of aperture to surface area, and taper of aperture was arrived at experimentally. In initial experiments, a sheet with a regular pattern of small (1 mm diameter) apertures over the entire surface of the sheet, each about 5 min apart, centre to centre, was tested. The sheet either had no backing or a thin backing. The apertures had no taper. The results with this sheet showed that it rapidly clogged with dust after which time, dust was expelled into the ambient atmosphere. This design was therefore deemed to be unsuitable for situations where the dust must be contained as best as possible. A sheet with larger, but fewer apertures was then tested. The apertures were regularly spaced over the surface. These apertures did not clog as quickly as the smaller apertures, but were still prone to clogging. The next design aligned the apertures with the grooves in the platen. This further improved the design, however, the sanding capacity was reduced by the size of the apertures. Through further experimentation, it was determined that the apertures should occupy no more than about 5% or 7% of the surface area of the sandpaper sheet as higher percentages reduced the sanding capacity below an acceptable level. It was then decided to test a sheet that had apertures with a smaller entrance port, a larger exit port and a tapered bore. The apertures were aligned with the grooves in the platen. This design overcame all the deficiencies in the earlier designs and provided a sandpaper sheet that allowed for direct extraction of substantially all the dust without it escaping into the ambient environment before being extracted, and without clogging the apertures. Without being bound to theory, the superior extraction provided by the tapered or funnel-shaped apertures can be explained by the increase in velocity of the air and dust as it is drawn into the taper or narrow part of the funnel.

While example embodiments have been described in connection with what is presently considered to be an example of a possible most practical and/or suitable embodiment, it is to be understood that the descriptions are not to be limited to the disclosed embodiments, but on the contrary, is intended to cover various modifications and equivalent arrangements included within the spirit and scope of the example embodiment. Those skilled in the art will recognize, or be able to ascertain using no more than routine experimentation, many equivalents to the specific example embodiments specifically described herein. Such equivalents are intended to be encompassed in the scope of the claims, if appended hereto or subsequently filed. For example, the apertures can be formed using tapered punches on a press.

The invention claimed is:

1. A sandpaper sheet for use with a vacuum extraction sander, the vacuum extraction sander having a platen with a pattern of grooves substantially covering the platen surface, the sandpaper sheet comprising: an upper sandpaper layer; a lower plastic polymer foam layer; a pair of long edges; a pair of short edges normal to the pair of long edges; and a plurality of series of apertures, the plurality of series of apertures in a pattern configured to align with the pattern of grooves in the platen of the sander, the plurality of series of apertures including an outer long side series which commences about 36 to about 38 mm from the short side edge and about 6 mm to about 9 mm from the long edge and an outer short side series which commence about 10 to about 12 mm from the short edge and about 10 mm to about 12 mm from the long edge, each aperture having a diameter of about 4 mm.

2. The sandpaper sheet of claim 1, further comprising a pair of central apertures, the central apertures having a diameter of about 8 mm.

3. The sandpaper sheet of claim 2, wherein each aperture of the plurality of series of apertures is substantially circular.

4. The sandpaper sheet of claim 3 further comprising a trace or a mark on the long edge and extending onto an upper surface of the upper sandpaper layer adjacent to an aperture in the outer long side series.

5. The sandpaper sheet of claim 4, wherein each aperture of the plurality of series of apertures has an entrance port at the upper sandpaper layer, an exit port at the lower plastic polymer foam layer and a bore therebetween, the bore tapering outwardly between a diameter of the entrance port and the exit port, the exit port having a larger diameter than the entrance port.

* * * * *